US005481784A

United States Patent [19]

Sinaiko

[11] Patent Number: 5,481,784

[45] Date of Patent: Jan. 9, 1996

[54] CLIP APPARATUS

[76] Inventor: Edwin S. Sinaiko, 180 E. Pearson, Chicago, Ill. 60611

[21] Appl. No.: 240,263

[22] Filed: May 10, 1994

[51] Int. Cl.[6] ..... B42F 1/00

[52] U.S. Cl. ..... 24/67.9; 24/67 AR; 24/67.11; 24/DIG. 11

[58] Field of Search ..... 24/67 AR, 67 R, 24/67.9, 67.11, 547, 304, DIG. 11; 248/205.2

[56] References Cited

U.S. PATENT DOCUMENTS

| | | | |
|---|---|---|---|
| 1,840,604 | 1/1932 | Randall | 24/67.11 |
| 2,030,135 | 2/1936 | Carpenter | 24/67 AR |
| 2,292,024 | 8/1942 | Dreher | 24/67 AR |
| 2,299,496 | 10/1942 | Rolfson | 24/66 |
| 2,665,463 | 1/1954 | Aurynger | 24/67.11 |
| 2,902,734 | 9/1959 | Walters | 24/67 AR |
| 2,947,047 | 8/1960 | Guzell | 24/66 |
| 3,057,027 | 10/1962 | Bugge | 24/66 |
| 3,840,943 | 10/1974 | Langwell | 24/67.9 |
| 3,885,768 | 5/1975 | Frye | 24/DIG. 11 |
| 3,913,181 | 10/1975 | Walker | 24/67.9 |
| 4,425,724 | 1/1984 | Scott | 40/11 A |
| 4,523,354 | 6/1985 | Tsukamoto | 24/67.9 |
| 4,932,626 | 6/1990 | Guillot | 248/205.2 |
| 4,951,408 | 8/1990 | Banks | 24/67.9 |
| 5,022,124 | 6/1991 | Yiin | 24/67.9 |
| 5,170,535 | 12/1992 | Strong | 24/67.9 |

*Primary Examiner*—Victor N. Sakran
*Attorney, Agent, or Firm*—Dick and Harris

[57] ABSTRACT

An improved clip apparatus having an associated attachment member for assisting in the maintenance of the clip apparatus in useful gripping contact with one or more items.

10 Claims, 1 Drawing Sheet

CLIP APPARATUS

BACKGROUND OF THE INVENTION

The present invention is directed to paper fasteners, and in particular, to paper clip apparatus.

The typical paper clip is capable of securely fastening only a few layers of material in a reliable manner. As the number and/or thickness of the layers increases, the gripping and holding power of the typical paper clip decreases. This is because the "U"-shaped portions which are the "legs" of the clip, become more and more spread apart, and the included angle between the legs increases, leaving less and less surface area of the legs in actual contact with the upper and lower layers of the bundle or packet of material being held together. Eventually, the included angle becomes so great, and the amount of useful surface area becomes so small, that the inherent resiliency of the clip will tend to propel the clip off of the bundle or packet, even if the bundle or packet is not being handled. If the bundle of materials are being handled, and individual layers being lifted, then the clip may tend to dislodge with even fewer or thinner layers present in the bundle.

A number of modifications of the standard paper clip have been attempted, seeking to improve their gripping power and resistance to dislocation. For example, the free ends have been turned outwardly from the "plane" of the clip, and/or pointed, as shown in U.S. Pat. Nos. 2,299,496 to Rolfson, or 2,947,047 to Guzell. Other prior art clips have had serrated surfaces, Rolfson '496 or U.S. Pat. No. 5,170, 535 to Strong, or wave-like distortions or flattened surfaces, as in U.S. Pat. No. 3,057,027 to Bugge, in order to increase the surface area of the clip which is in contact with the layers to be held together. Still other prior art devices have employed locking type configurations, U.S. Pat. No. 3,840, 943 to Langwell, or unusual scissor-like or clamping configurations, as in U.S. Pat. No. 4,523,354 to Tsukamoto or No. 5,022,124 to Yiin, respectively.

Yet another prior art device, disclosed in Walker, U.S. Pat. No. 3,913,181, provides a coating to the loop surfaces of the clip, so as to raise the coefficient of friction to help enhance the gripping power and resistance to dislodging of the clip. The usefulness of the coating is still limited by the fact that, as the thickness of the bundle increases, less and less of the surface area of the clip, and thus less and less of the surface area of the coating, makes contact with the layers, Accordingly, the full potential of the frictional coating cannot be utilized.

It is an object of the invention to provide an improved clip apparatus which is capable of usefully holding a greater thickness of layers of material, than conventional standard paper clips.

Another object of the invention is to provide an improved clip apparatus which has increased resistance to dislodging from the articles being clipped.

Still another object of the invention is to provide an improved clip apparatus which is inexpensive and simple to manufacture.

These and other objects of the invention will become apparent in light of the present specification, claims and drawings.

SUMMARY OF THE INVENTION

The present invention is directed to a clip apparatus for affixation to a stack formed of one or more layers of substantially planar material, such as sheets of paper. The clip apparatus comprises a clip member, including a first contact portion, and a second contact portion arranged in internesting relation to the first contact portion. The first and second contact portions are operably associated with one another so as to be resiliently separable or displaceable in angular relation to one another, so as to enable insertion of the stack between the angularly displaced first and second contact portions, such that the first and second contact portions will engage the stack therebetween in a biased gripping manner. The clip apparatus also comprises means for engaging at least one layer of the stack, at positions substantially remote from the clip member, for resisting dislodging of the clip member from the stack. The means for engaging at least one layer of the stack are operably associated with the clip member.

in a preferred embodiment of the invention, the first and second contact portions are substantially U-shaped, though other configurations are contemplated as being within the scope of the invention.

In a preferred embodiment of the invention, the means for engaging at least one layer of the stack further comprises at least one flexible strip member operably affixed to the clip member; and means for releasably adhering the at least one strip member to the at least one layer of the stack. In one embodiment of the invention, the at least one flexible strip member comprises at least one strip of fabric tape. In another embodiment, the at least one flexible strip member is at least one strip of cellophane tape. Other suitable materials for the flexible strip member are contemplated as being within the scope of the invention.

The means for releasably adhering the at least one strip member to the at least one layer of the stack is a releasable adhesive material distributed about one side of the at least one strip member. The means for releasably adhering the at least one strip member to the at least one layer of the stack may also include at least one removable protective covering member operably disposed over the releasable adhesive material, to prevent contact with the releasable adhesive material prior to placement of the clip apparatus on the stack to be clipped.

The clip apparatus according to the present invention may also comprise means for interengagement of the clip member with the means for engaging at least one layer of the stack, so as to preclude separation of the clip member from the means for engaging at least one layer of the stack, which may, in turn, comprise at least one enclosing member, operably disposed on the means for engaging at least one layer of the stack, operably surrounding a portion of the clip member.

The means for releasably adhering the at least one strip member to the at least one layer of the stack may also include at least one tab member, operably associated with the at least one removable protective covering member, for facilitating removal of the at least one protective covering member from the at least one strip member.

DETAILED DESCRIPTION OF THE DRAWINGS

Figure 1:
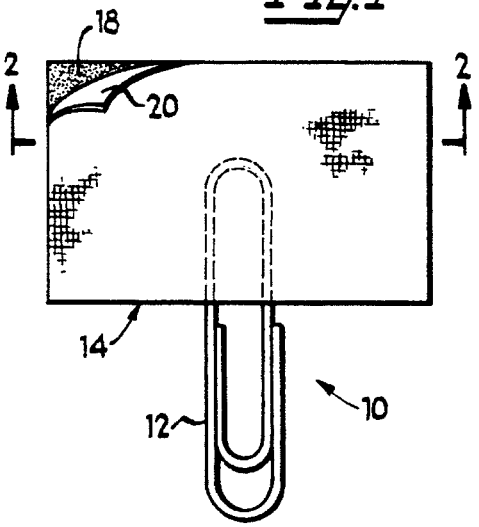
FIG. 1 is a bottom side view of the clip apparatus according to the present invention.

While the present invention is susceptible of embodiment in many different forms, there is shown in the drawings and will be described in detail herein, several specific embodiments, with the understanding that the present disclosure is to be considered as an exemplification of the principles of the invention, and is not intended to limit the invention to the embodiments described.

Figure 2:
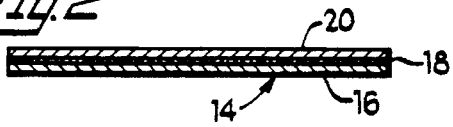
FIG. 2 is an end elevation, in section, of the clip apparatus according to FIG. 1, taken along line 2—2 of FIG. 1.

Clip apparatus 10 is shown in FIG. 1, and includes clip member 12, and tape member 14. Tape member 14 includes a base layer 16, an adhesive layer 18, and a cover layer 20, as indicated in FIG. 2, a sectional view taken along line 2—2 of FIG. 1. In this embodiment, clip member 12 is partially embedded in tape member 14, between adhesive layer 18 and cover layer 20.

Preferably, adhesive layer 18 is the form of adhesive which permits tape member 14 to be peeled away from whatever surface it is placed against, without damage to that surface. The adhesive used could be of the same type used in 3M Brand POST-IT (Reg. Trademark) self-stick removable notes. Other suitable types of adhesives could be used. However, any such adhesive should be of the type that does not harm or strain the stack being contacted and held. Removal of cover layer 20 is likewise accomplished by peeling away cover layer 20 from adhesive layer 18, as suggested by FIG. 1.

Figure 3:
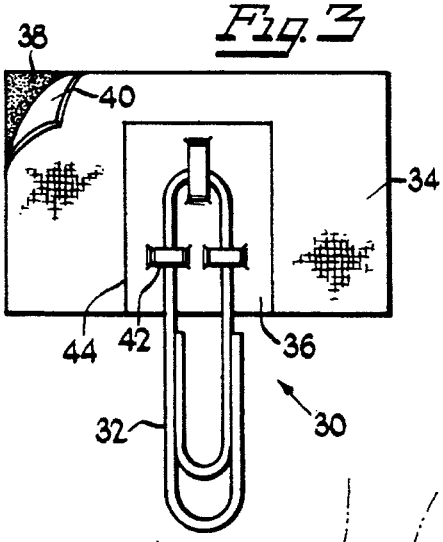
FIG. 3 is a bottom side view of the clip apparatus according to an alternative embodiment of the invention.

Clip apparatus 30 is shown in FIG. 3, and includes clip member 32, and tape member 34. In a preferred embodiment of the invention, tape member 34 includes base layer 36, adhesive layer 38, and a removable cover layer 40. Tape member 34 is attached to clip member 32 by one or more slots 42 in tape member 34, through which clip member 32 passes, though other means of attachment are contemplated. In the embodiment shown, cover layer 40 and adhesive layer 38 are omitted in a region surrounding slots 42, demarcated by border 44, although, in an alternative embodiment, adhesive layer 38 and cover layer 40 could homogeneously cover base layer 36. In such an alternative embodiment, a series of perforations could be placed in the cover layer 40, more or less where the border 44 is indicated in FIG. 3, so that when the cover layer 40 would be peeled away from the adhesive layer 38, cover layer 40 would part along the perforations.

Figure 4:
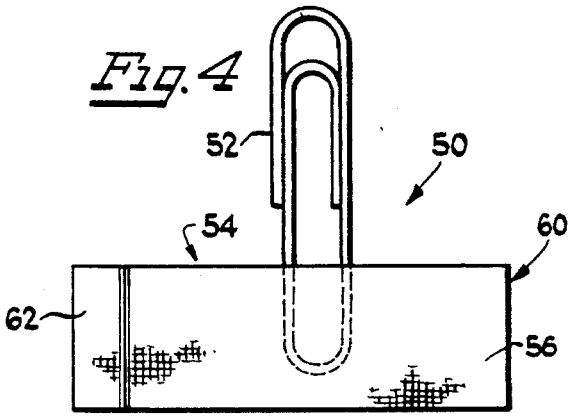
FIG. 4 is a top side view of the clip apparatus according to a third alternative embodiment of the invention.
Figure 5:
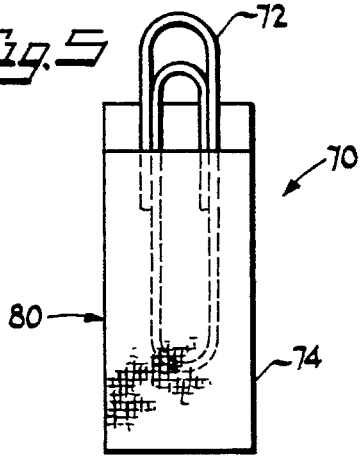
FIG. 5 is a top side view of the clip apparatus according to a fourth embodiment of the invention.

As show in FIGS. 4 and 5, cover layer 40 could also be provided with elongated flaps that extend beyond the edges of the adhesive layer to facilitate removal of cover layer therefrom.

For example, in the embodiment of FIG. 4, clip apparatus 50 includes clip member 52 embedded between base layer 56 and cover layer 60. Cover layer 60 includes at one end tab 62, In this embodiment, tape member 54 extends transversely to clip member 52.

Alternatively, in FIG. 5, clip apparatus 70 features a tape member 74 which extends parallel to clip member 72. Pull tab 82 may be positioned either at the clip member end of tape member 74, as illustrated, or at the opposite end.

Figure 6:
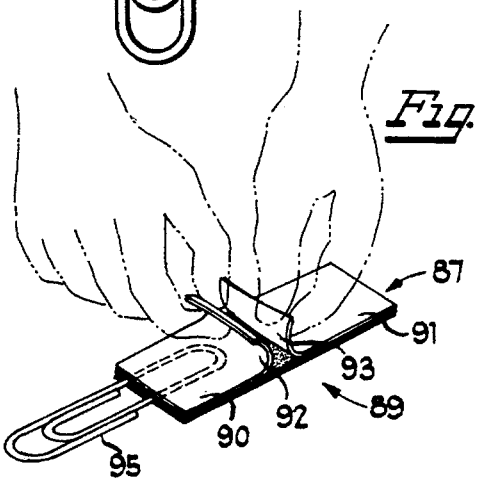
FIG. 6 is a bottom side view of the clip apparatus according to a fifth embodiment of the invention, showing how the adhesive is exposed.

In a further alternative, two cover members 90, 91 may be provided on clip apparatus 89, with two pull tabs 92, 93 juxtaposed in a manner similar to the employed with the cover strips of adhesive bandages, and which are removed in a similar manner, as indicated in FIG. 6.

Figure 7:
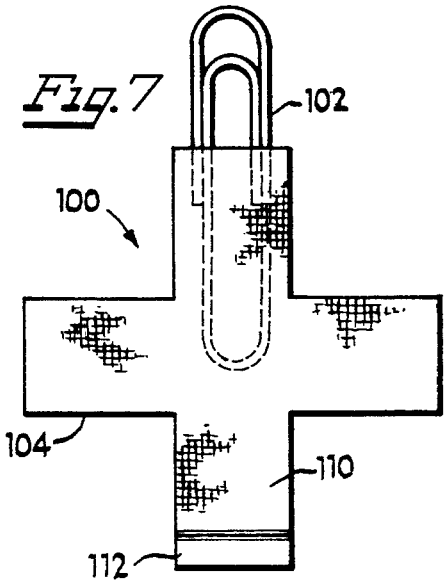
FIG. 7 is a top side view of the clip apparatus according to a sixth embodiment of the invention.

In a still further alternative embodiment, the tape member 104 of clip apparatus 100 may be cross-shaped, as shown in FIG. 7. Clip member 102 is embedded in tape member 104 as in previous embodiments. One cover member 110, with pull tab 112 may be employed, as illustrated, or a plurality of cover members and pull tabs may be provided.

In any embodiment, the pulling force required to remove cover layer should not be so much as to prevent children from being able to easily pull the cover layer from adhesive layer either before or after placement of clip member on the stack to be clipped.

Although a standard office-type paper clip is shown in FIGS. 1–7, the present invention is also applicable to paper or other clips having other configurations, such as the known triangle-shaped clips. In addition, the present invention contemplates other means for attaching the clip member to the tape member. Instead of slots, for example, separate strips of material could be added to overlie the clip member. Alternatively, the clip member could be threaded through the weave of a fabric tape member, or, if a plastic or similar tape member is used, the tape material could be deposited or formed around the end of the clip member.

IN a preferred embodiment of the invention, the tape members are formed from a light cellophane or plastic material, although for improved strength and tear resistance, a fabric tape of other suitable material could also be used. The adhesive layers are comprised of the sort of releasable light adhesive of the form sometimes known as fugitive glue, although a more permanent form of adhesive could be used for clips for more permanent applications.

In use, one assembles the stack of materials to be clipped. The method of use in any embodiment is substantially the same. The clip member 12 (32, 52, 72, 95, 102) is affixed to the top or side of the stack, in the usual manner, with the cover layer 20 (40, 60, 80, 90, 91,110) facing against the top sheet of the stack. The cover layer 20 (40, 60, 80, 90, 91, 110)is then peeled away, revealing the adhesive layer 18 (38). The tape member 14 (34, 54, 74, 87, 114)is then folded around the edge of the stack and pressed more or less firmly, as desired, against the topmost and bottommost layers of the stack. Once in place, tape member 14 (34, 54, 74, 87, 114) will act to prevent clip member 12 (32, 52, 72, 95, 102) from working loose from the stack. To remove clip apparatus 10 (30, 50, 70, 89, 100), tape member 14 (34, 54, 74, 87, 114) may be peeled away from the stack, if a releasable adhesive is used. Alternatively, tape member 14 (34, 54, 74, 87, 114) may simply be cut, around the enclosed end of clip member 12 (32, 52, 72, 95, 102), and along the edge of the stack, to enable the clip member 12 (32, 52, 72, 95, 102) to be removed, and permit separation of the individual members of the stack.

The foregoing description and drawings merely explain and illustrate the invention, and the invention is not limited thereto except insofar as the appended claims are so limited, as those skilled in the art who have the disclosure before them will be able to make modifications and variations therein without departing from the scope of the invention.

What is claimed is:

1. An improved clip apparatus for affixation to a stack formed of one or more layers of substantially planar material, said clip apparatus comprising:

a clip member, including a first contact portion, and a second contact portion arranged in internesting relation to the first contact portion, the first and second contact portions being operably associated with one another so as to be resiliently displaceable in angular relation to one another, so as to enable insertion of the stack between the angularly displaced first and second contact portions, such that the first and second contact portions will engage the stack therebetween in a biased gripping manner;

means for removably engaging at least one layer of the stack, at positions substantially remote from the clip member, for resisting dislodging of the clip member from the stack, the means for engaging at least one layer of the stack being operably associated with the clip member; and means for interengagement of the clip member with the means for engaging at least one layer of the stack, operably associated with the means for removably engaging at least one layer of the stack, and operably configured so as to preclude separation of the clip member from the means for engaging at least one layer of the stack, said interengagement means being further operably configured so as to maintain at least a portion of said means for removably engaging at least one layer of the stack in a substantially fixed, stable orientation relative to the clip member.

2. The improved clip apparatus according to claim 1 wherein said first and second contact portions are substantially U-shaped.

3. The improved clip apparatus according to claim 1, wherein the means for engaging at least one layer of the stack further comprises:

at least one flexible strip member operably affixed to the clip member; and means for releasably adhering the at least one strip member to the at least one layer of the stack.

4. The improved clip apparatus according to claim 3, wherein the at least one flexible strip member comprises:

at least one strip of fabric tape.

5. The improved clip apparatus according to claim 3, wherein the at least one flexible strip member comprises:

at least one strip of cellophane tape.

6. The improved clip apparatus according to claim 3, wherein the means for releasably adhering the at least one strip member to the at least one layer of the stack comprises:

a releasable adhesive material distributed about one side of the at least one strip member.

7. The improved clip apparatus according to claim 6, wherein the means for releasably adhering the at least one strip member to the at least one layer of the stack comprises:

at least one removable protective covering member operably disposed over the releasable adhesive material, to prevent contact with the releasable adhesive material prior to placement of the clip apparatus on the stack to be clipped.

8. The improved clip apparatus according to claim 7, wherein the means for releasably adhering the at least one strip member to the at least one layer of the stack comprises:

at least one tab member operably associated with the at least one removable protective covering member for facilitating removal of same from the at least one strip member.

at least one tab member operably associated with the at least one removable

9. The improved clip apparatus according to claim 1, further comprising:

means for interengagement of the clip member with the means for engaging at least one layer of the stack, so as to preclude separation of the clip member from the means for engaging at least one layer of the stack.

10. The clip apparatus according to claim 1, wherein the means for interengagement further comprises:

at least one enclosing member, operably disposed on the means for engaging at least one layer of the stack, operably surrounding a portion of the clip member.

* * * * *